US007510414B2

(12) United States Patent
Yu et al.

(10) Patent No.: US 7,510,414 B2
(45) Date of Patent: Mar. 31, 2009

(54) ELECTRICAL CARD CONNECTOR

(75) Inventors: Hung-Chi Yu, Tu-Cheng (TW); Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/978,862

(22) Filed: Oct. 30, 2007

(65) Prior Publication Data

US 2008/0102705 A1 May 1, 2008

(30) Foreign Application Priority Data

Oct. 30, 2006 (TW) ..... 95219112 U
Nov. 28, 2006 (TW) ..... 95220945 U
May 28, 2007 (TW) ..... 96118912 A

(51) Int. Cl.
*H01R 13/62* (2006.01)

(52) U.S. Cl. ..... 439/159; 439/541.5; 439/570

(58) Field of Classification Search ..... 439/159, 439/541.5, 570, 160, 630, 571
See application file for complete search history.

(56) References Cited

U.S. PATENT DOCUMENTS 5,470,241 A * 11/1995 Kaufman et al. ..... 439/159
6,478,592 B1 * 11/2002 Hu et al. ..... 439/159
6,558,175 B1 * 5/2003 Yu ..... 439/138
6,979,201 B1 12/2005 Lee
7,086,895 B1 * 8/2006 Ting ..... 439/541.5
7,179,103 B2 8/2006 Ting
7,101,222 B2 9/2006 Ho
7,189,088 B2 3/2007 Ting
7,384,310 B2 * 6/2008 Hu et al. ..... 439/607
7,416,429 B1 * 8/2008 Hung ..... 439/188
2003/0114031 A1 * 6/2003 Hu et al. ..... 439/159

* cited by examiner

*Primary Examiner*—Gary F. Paumen
(74) *Attorney, Agent, or Firm*—Wei Te Chung

(57) ABSTRACT

An electrical card connector (100) includes a first connector (1) and a second connector (2). The first connector includes a first insulating housing (12), a first shield (11) mounted on the first insulating housing to define a first receiving room (10), and a plurality of first terminals (13) retained in the first insulating housing. The second connector (2) is mounted under the first connector, and includes a second insulating housing (22) to define a second receiving room (20), and a plurality of second terminals (23) retained in the second insulating housing. Wherein the first insulating housing includes a base section (121) having an embossment (125), the embossment protruding into the second receiving room.

18 Claims, 11 Drawing Sheets

ELECTRICAL CARD CONNECTOR

BACKGROUND OF THE INVENTION

1. Field of the Invention

The present invention relates to an electrical card connector for accessing electrical cards, such as memory cards; and more particularly to an electrical card connector for accommodating different cards.

2. Description of Prior Arts

Memory cards are used in many applications in today's electronic society, such as video cameras, smartphones, music players, ATMs, cable television decoders, toys, games, PC adapters and so on. A typical memory card includes a contact or terminal array for connecting an electrical card connector to a card reader system and then to external equipment. The electrical card connector readily accommodates insertion and removal of the card to provide quick access to the information and program on the card. A number of terminals are retained in the electrical card connector for engaging the contact or terminal array of the card.

An electrical card connector having two receiving rooms is provided to receive two cards in different size. U.S. Pat. No. 7,189,088, for example, discloses such an electrical card connector having a metal plate between a first connector and a second connector. The metal plate forms a stopping portion protruding into the second connector for preventing a first card from mismating into the second connector. Because the first card has a larger thick head than that of the second card, when the first card is inserted into the second connector, the head of the first card would confront with the stopping portion of the metal plate and be blocked off, but the front portion of the second card can go through the stopping portion till a recess portion of the second card engaging with the stopping portion and electrically connecting with the electrical card connector.

However, one problem of said electrical card connector is that the stopping portion is formed by the metal plate, and the metal plate is made of a thin metal plate, as well as the stopping portion. If the first card or the second card is inserted into the second connector fiercely, the stopping portion would be distorted. Furthermore, repeatedly colliding with the cards, the stopping portion tends to bend in a card inserted direction and can not prevent the first card from mismating. The present invention is directed to solving the problems.

SUMMARY OF THE INVENTION

An object, therefore, of the invention is to provide an electrical card connector for receiving different cards, which can avoid the cards from mismating.

In the exemplary embodiment of the invention, an electrical card connector includes a first connector and a second connector. The first connector includes a first insulating housing, a first shield mounted on the first insulating housing to define a first receiving room, and a plurality of first terminals retained in the first insulating housing. The second connector mounted under the first connector, includes a second insulating housing to define a second receiving room, and a plurality of second terminals retained in the second insulating housing. Wherein the first insulating housing includes a base section having an embossment, the embossment protruding into the second receiving room.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 11:
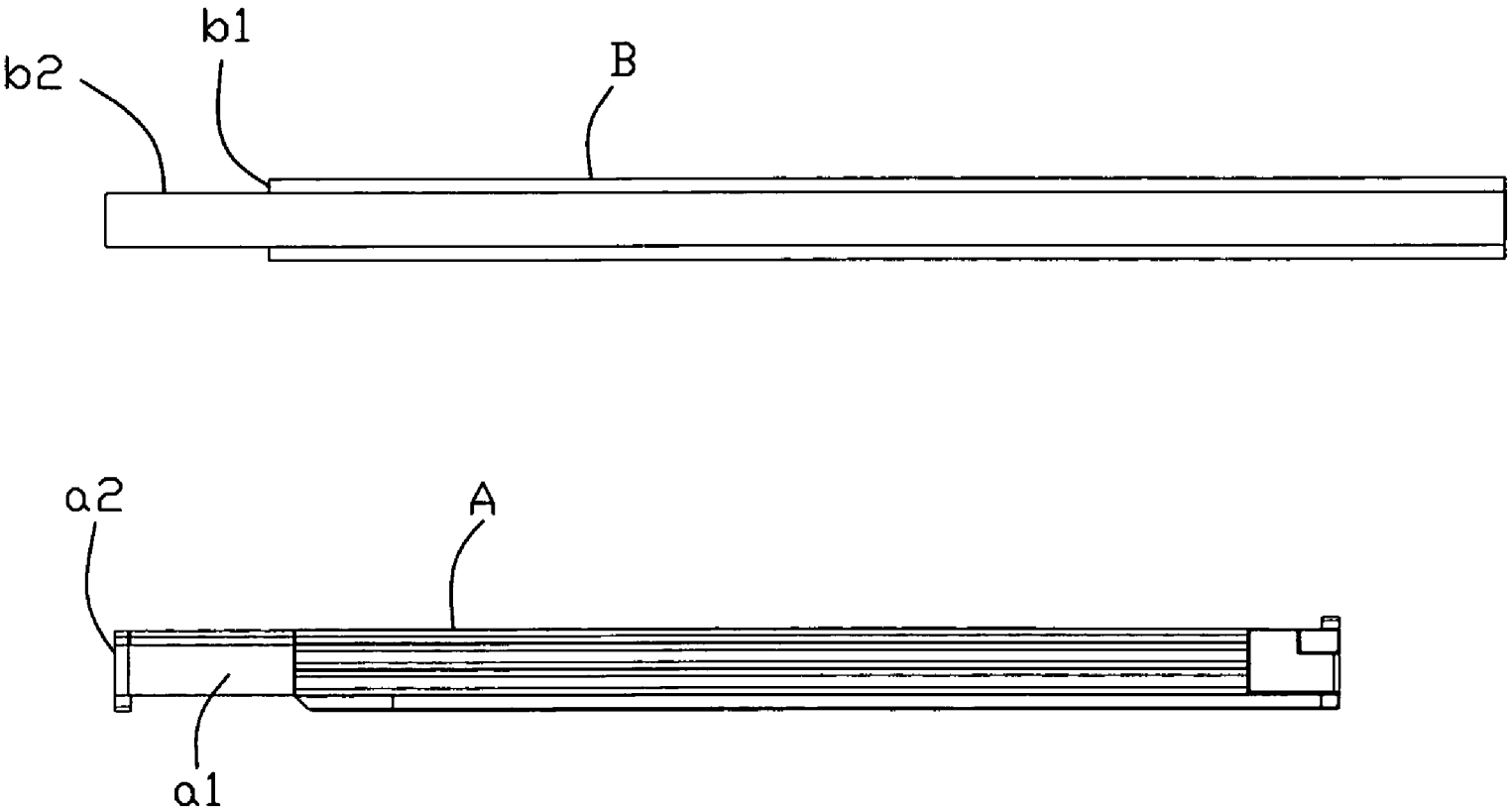
FIG. 11 is an elevational view of a first card and a second card.

Referring to FIG. 1 to FIG. 7, a perspective, assembly view of an electrical card connector 100 in accordance with present invention is shown. The electrical card connector 100 has a first connector 1 defining a first receiving room 10 for receiving a first card A (shown in FIG. 11), a second connector 2 defining a second receiving room 20 for receiving a second card B (shown in FIG. 11), a third connector 3 defining a third receiving room 30 for receiving a third card (not shown), and a pair of supporting plates 4 and 5 located on both lateral sides of the electrical card connector 100, respectively.

Figure 1:
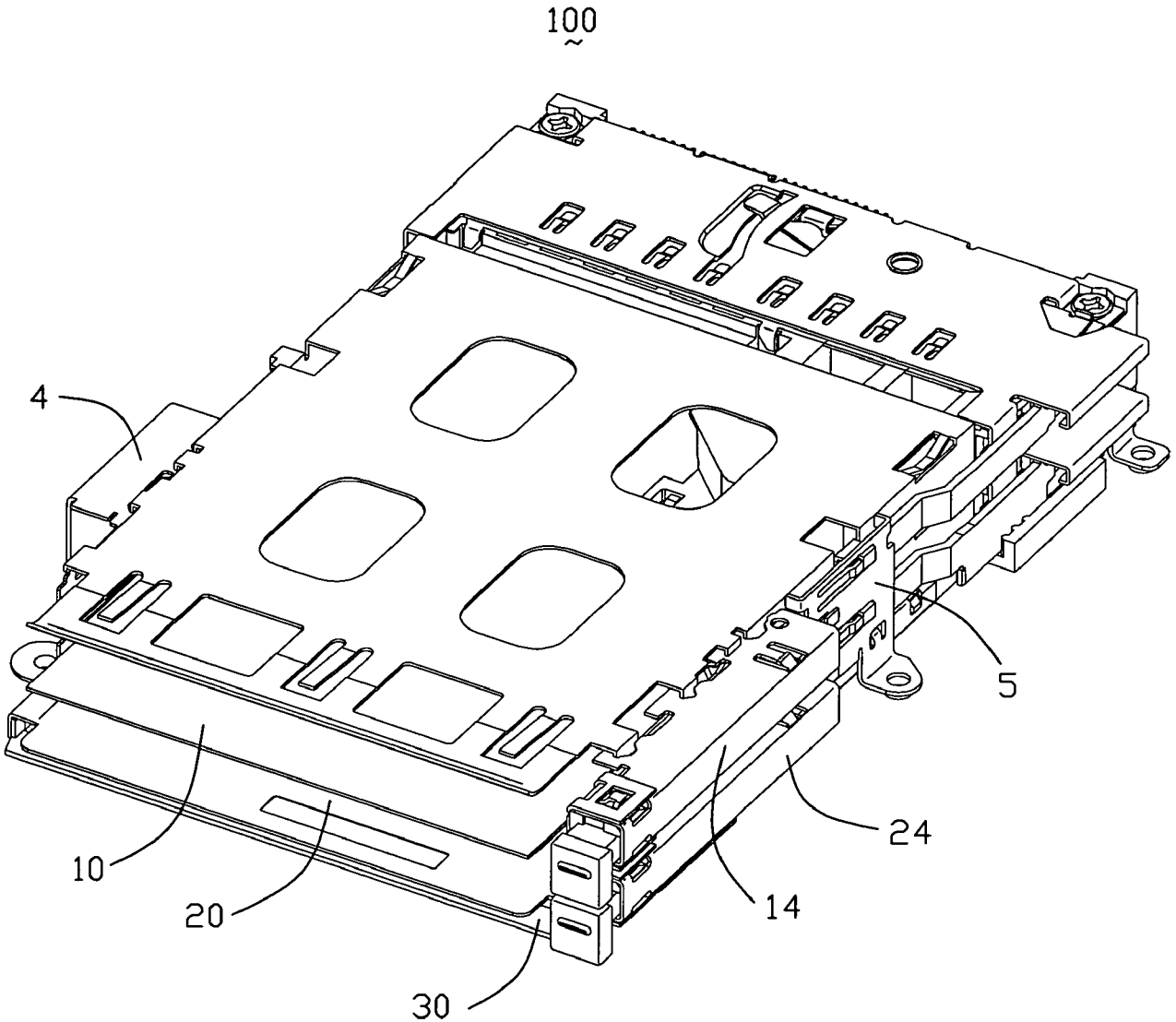
FIG. 1 is a perspective, assembly view of an electrical card connector in accordance with the present invention.
Figure 2:
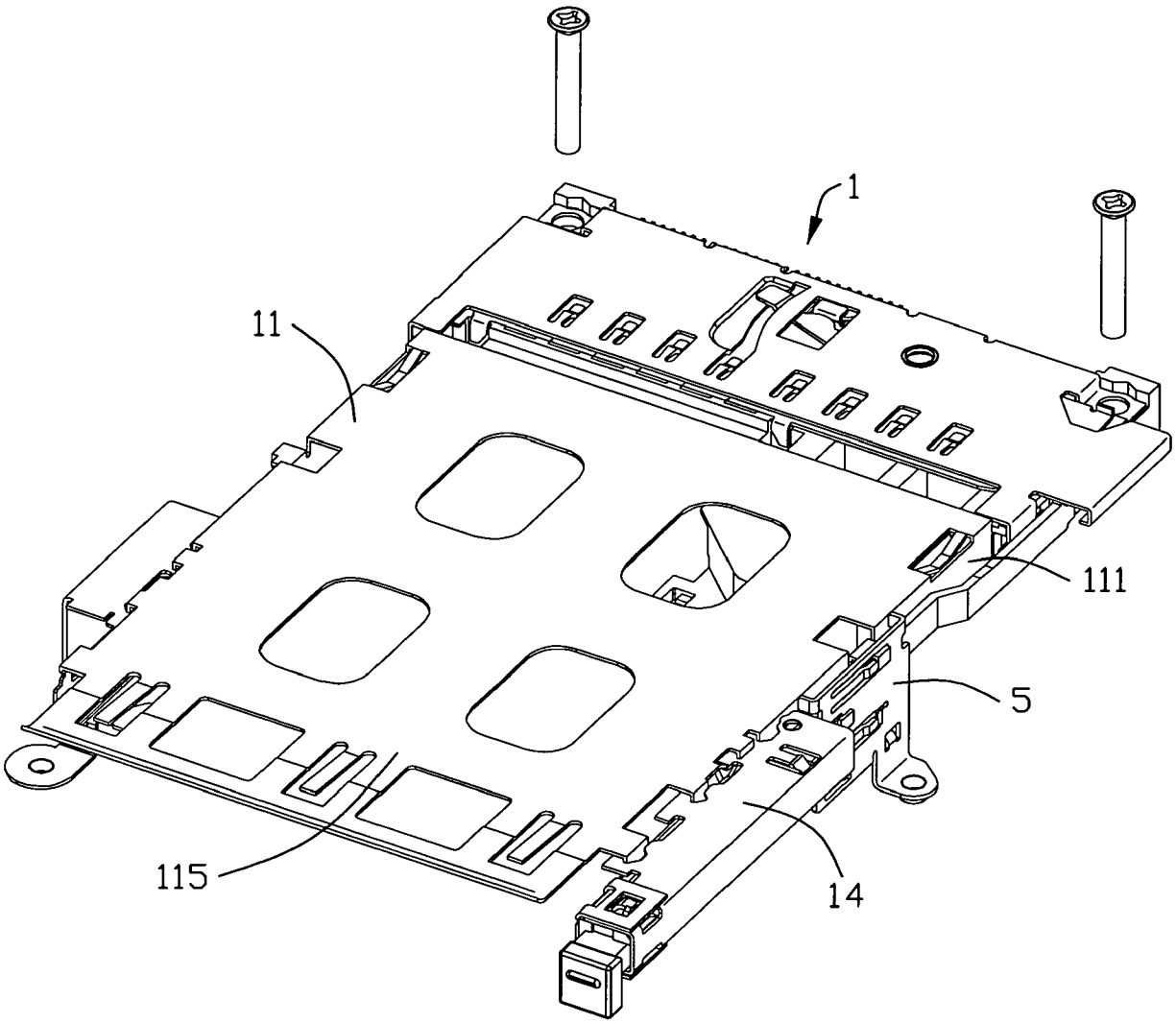
FIG. 2 is a perspective view showing a first connector of the electrical card connector shown in FIG. 1.
Figure 3:
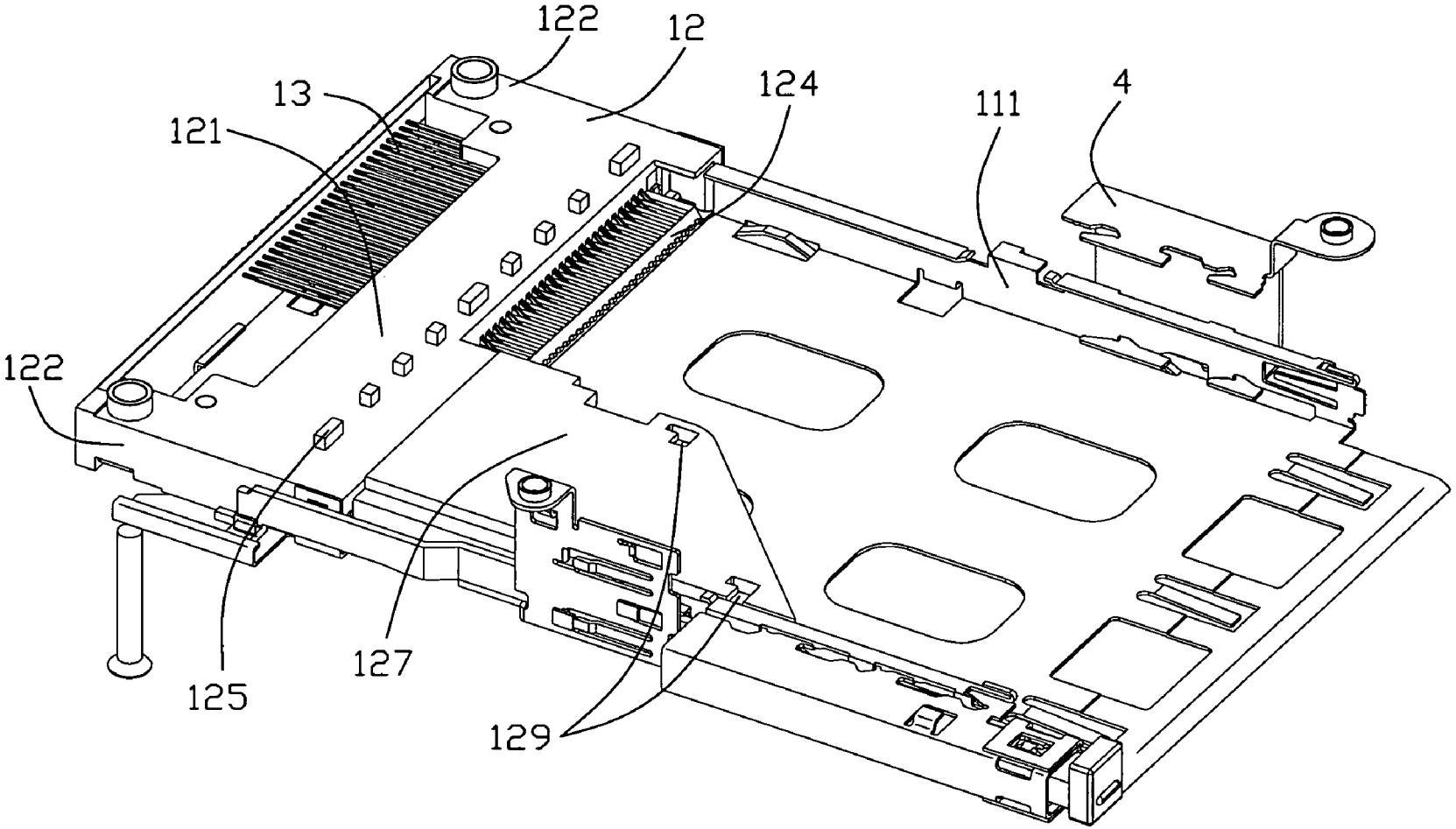
FIG. 3 is similar to FIG. 2, but taken from another aspect.

As shown in FIG. 2 and FIG. 3, the first connector 1 includes a first shield 11, a first insulating housing 12 receiving a plurality of first terminals 13 and a first grounding plate (not labeled) mounted on the first insulating housing 12. The first grounding plate with a pair of screw holes (not labeled) is placed at the end of the first shield 11. In alignment with the screw holes of the first grounding plate, a pair of screw holes are defined on the end of the first insulating housing 12. The first terminals 13 are retained in the first insulating housing 12 and protruding into the first receiving room 10 (shown in FIG. 1) for electrically contacting with the first card A. The first shield 11, the first grounding plate and the first insulating housing 12 define the generally L-shaped first receiving room 10 adapted for selectively receiving an I-shaped or L-shaped card. Additionally, the first shield 11 has a body portion 115 and a number of lateral walls 111 extending downwardly from the body portion 115. A first ejecting member 14, for ejecting the first card A, is located on a side of one lateral wall 111.

The first insulating housing 12, a generally rectangular structure, has a base section 121, a pair of guiding arms 122 extending forwardly from the opposite ends of the base section 121, and a tongue-type engaging portion 124 extending backwardly from the base section 121 between the arms 122. Each first terminal 13 is retained in corresponding passageway (not labeled) of the engaging portion 124. A guiding plate 127 extends backwardly form the base section 121 for guiding a card inserted. On the guiding plate 127, a pair of locking holes 129 are defined near to an inclined edge of the guiding plate 127. A number of embossments 125 are formed on the base section 121 in a transverse direction which is vertical to the direction of the card inserted. The embossments 125 share a common space, but are different in size.

Figure 4:
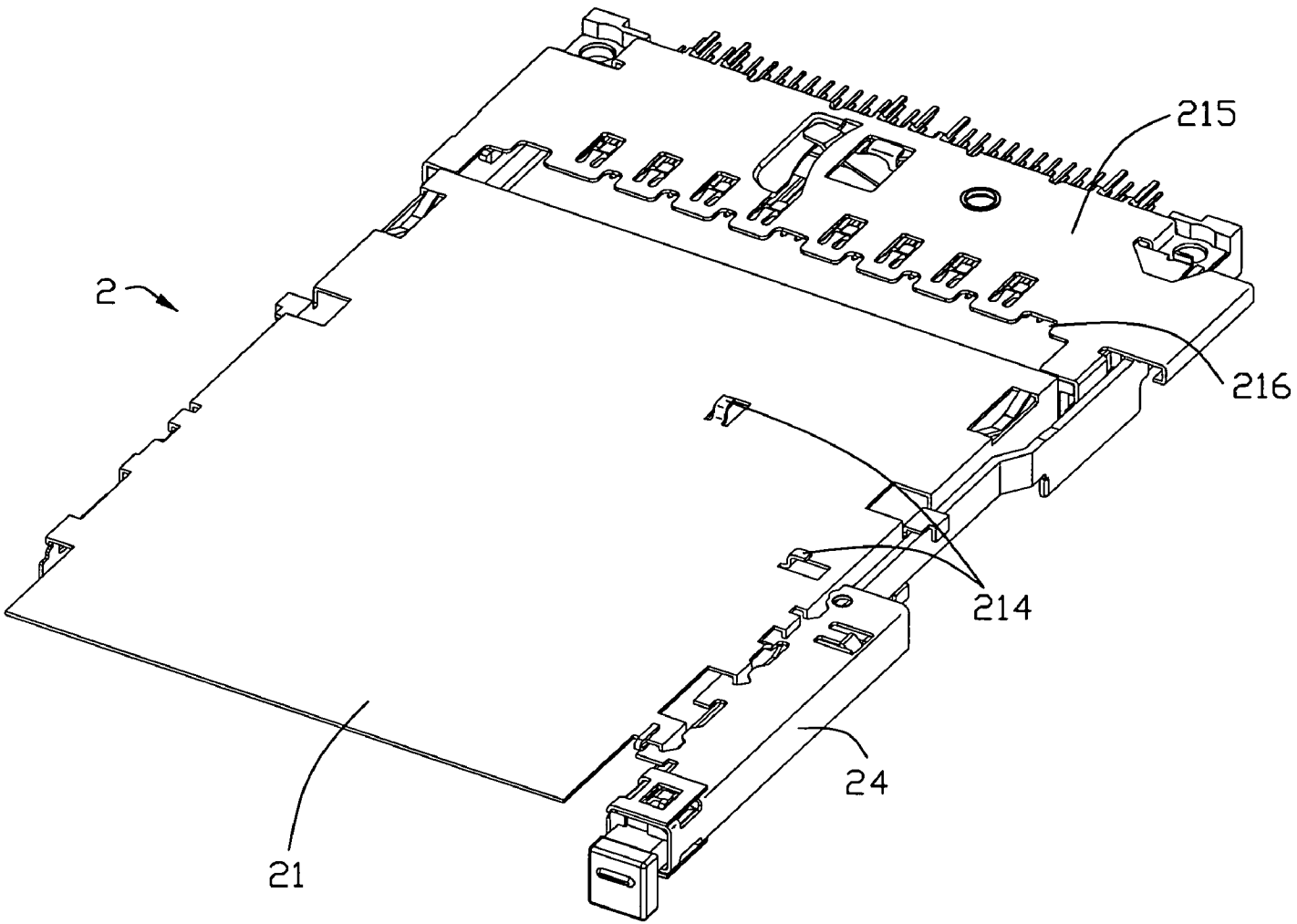
FIG. 4 is a perspective view of a second connector of the electrical card connector shown in FIG. 1.
Figure 5:
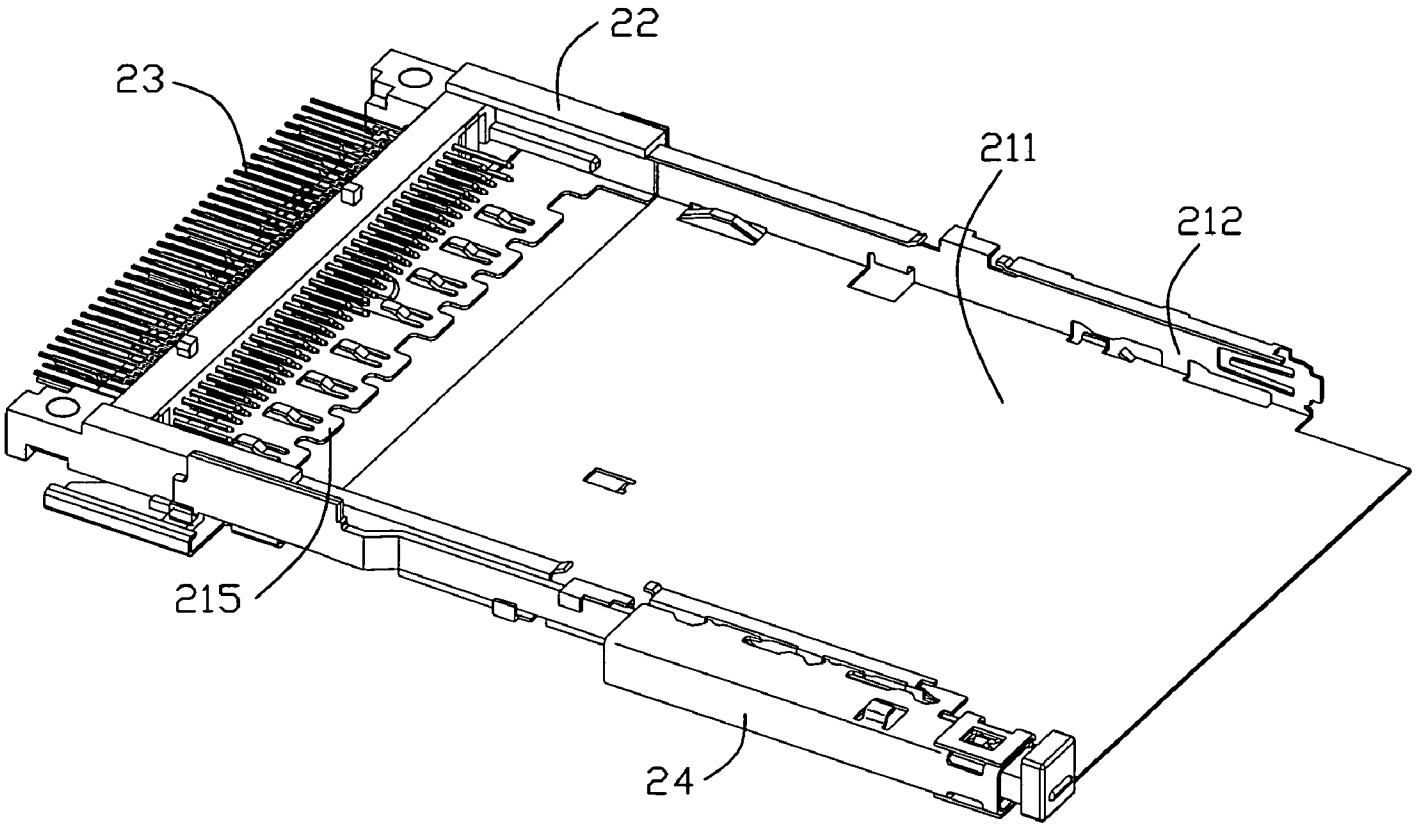
FIG. 5 is similar to FIG. 4, but taken from another aspect.

FIG. 4 and FIG. 5 show a second connector 2 in different aspects. The second card connector 2 located under the first connector 1 (shown in FIG. 2) comprises a second shield 21, a second insulating housing 22 receiving a plurality of second terminals 23, and a second grounding plate 215 mounted on the second insulating housing 22. In accordance with the screw holes of the first connector 1, the second grounding plate 215 and the second insulating housing 2 define a pair of screw holes (not labeled), respectively. The second shield 21, the second insulating housing 22, and the second grounding plate 215 define the second receiving room 20 (shown in FIG. 1). Furthermore, the second shield 21 has a body face 211 with a pair of tabs 214. Each tab 214 is adapted for locking with the locking holes 129 of the guiding plate 127. In according with the embossments 125 of the first insulating housing 12, a row of setting portions 216 are formed on the transverse edge of the second grounding plate 215. Each embossment 125 goes through corresponding setting portion 216, and protrudes into the second receiving room 20. When the second card B (shown in FIG. 11) is inserted into the second receiving room 20, a head portion b2 (shown in FIG. 11) of the second card B goes through the embossments 125 properly, till a higher face b1 engaging with the embossments 125. If the first card A (shown in FIG. 11) mismates into the second receiving room 20, a head portion a2 extending from a back portion a1 of the first card A would be stopped by the embossments 125, because the head portion a2 is thicker than the head portion b2 of the second card B. In such way, the embossments not only can prevent the first card A from mismating into the second receiving room 20, but also make the first connector 1 and the second connector 2 assembled more firmly, by the embossments 125 engaging with the second grounding plate 215.

Figure 6:
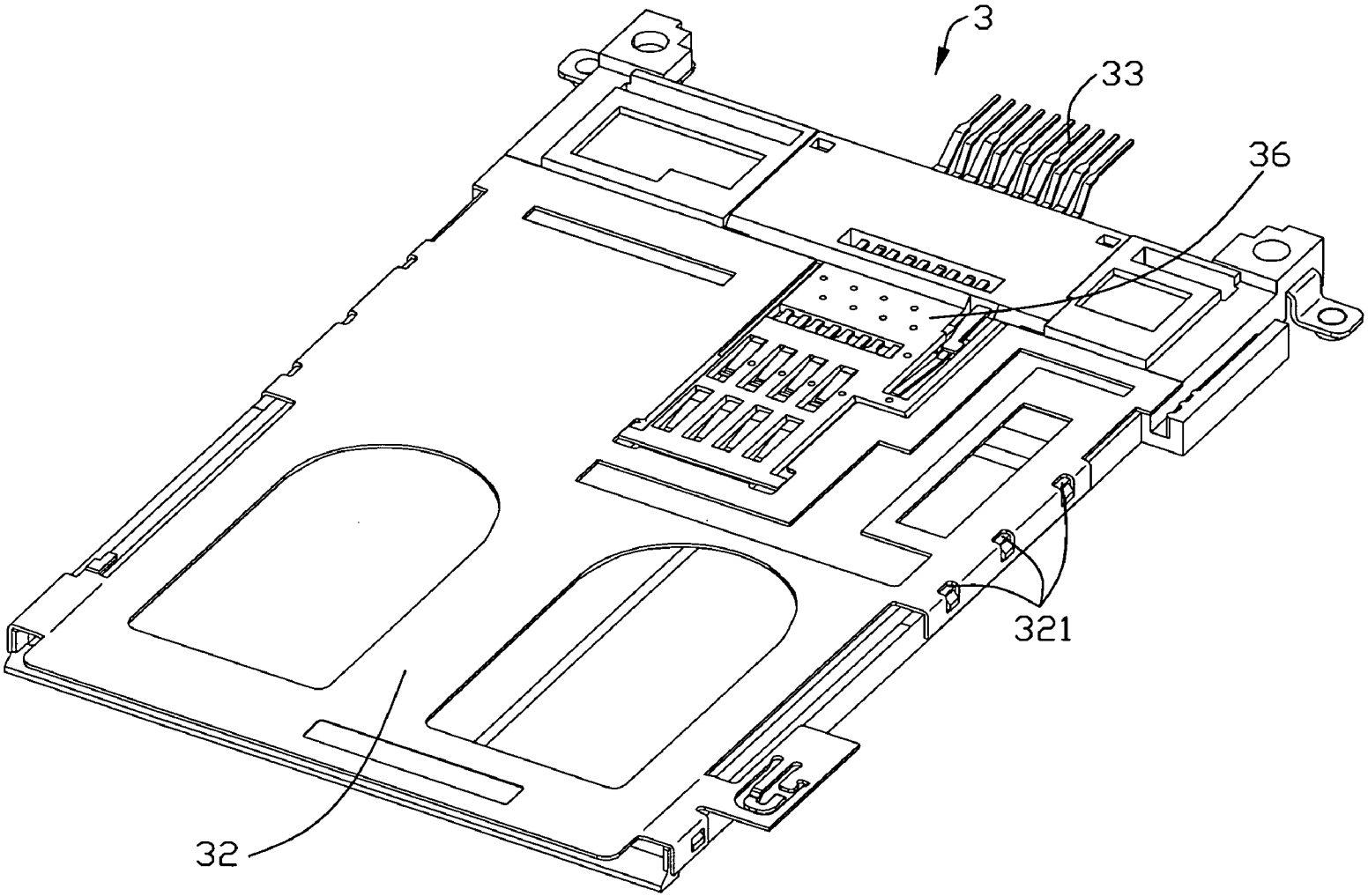
FIG. 6 is a perspective view of a third connector of the electrical card connector shown in FIG. 1.
Figure 7:
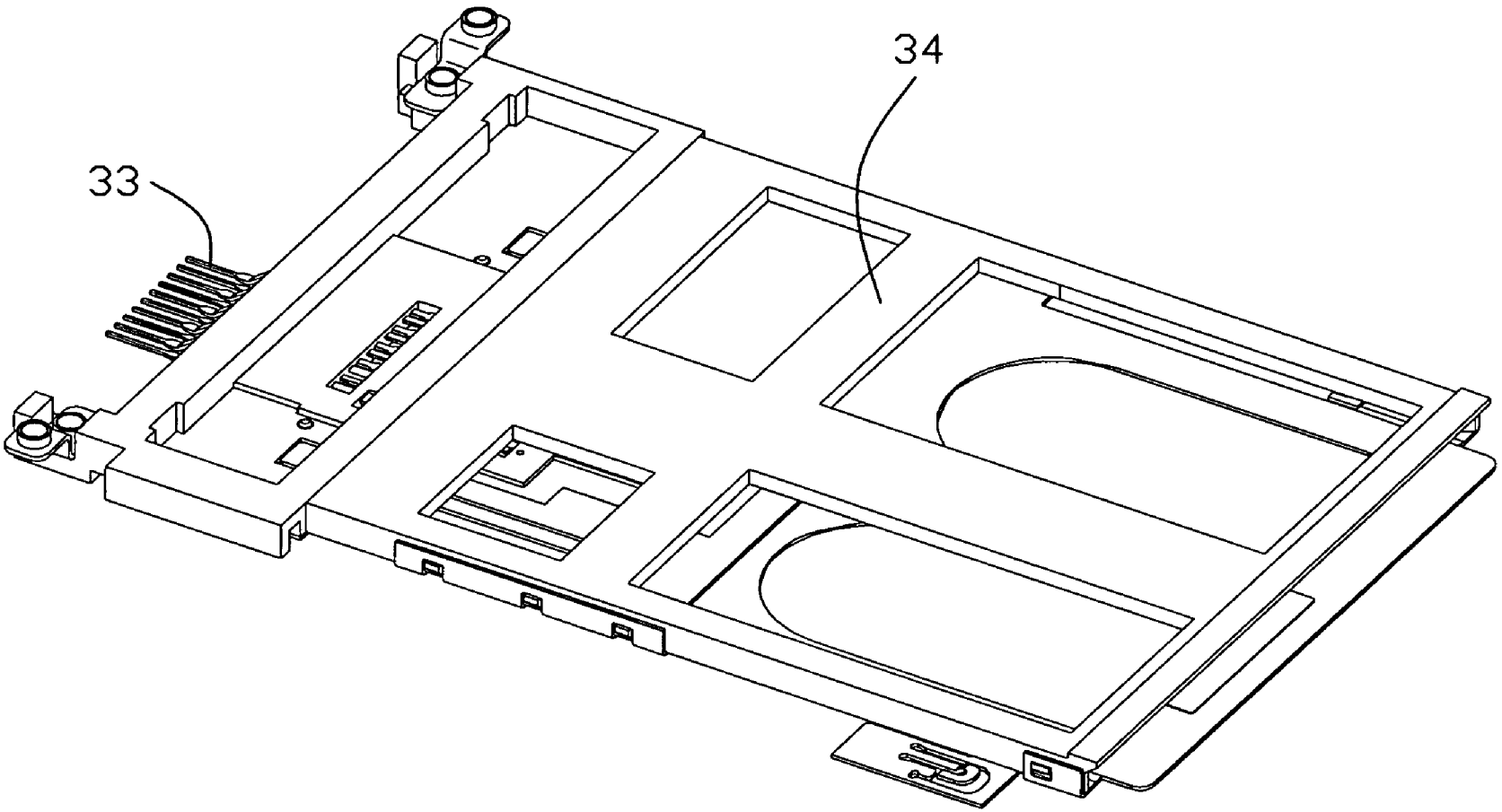
FIG. 7 is similar to FIG. 6, but taken from another aspect.
Figure 8:
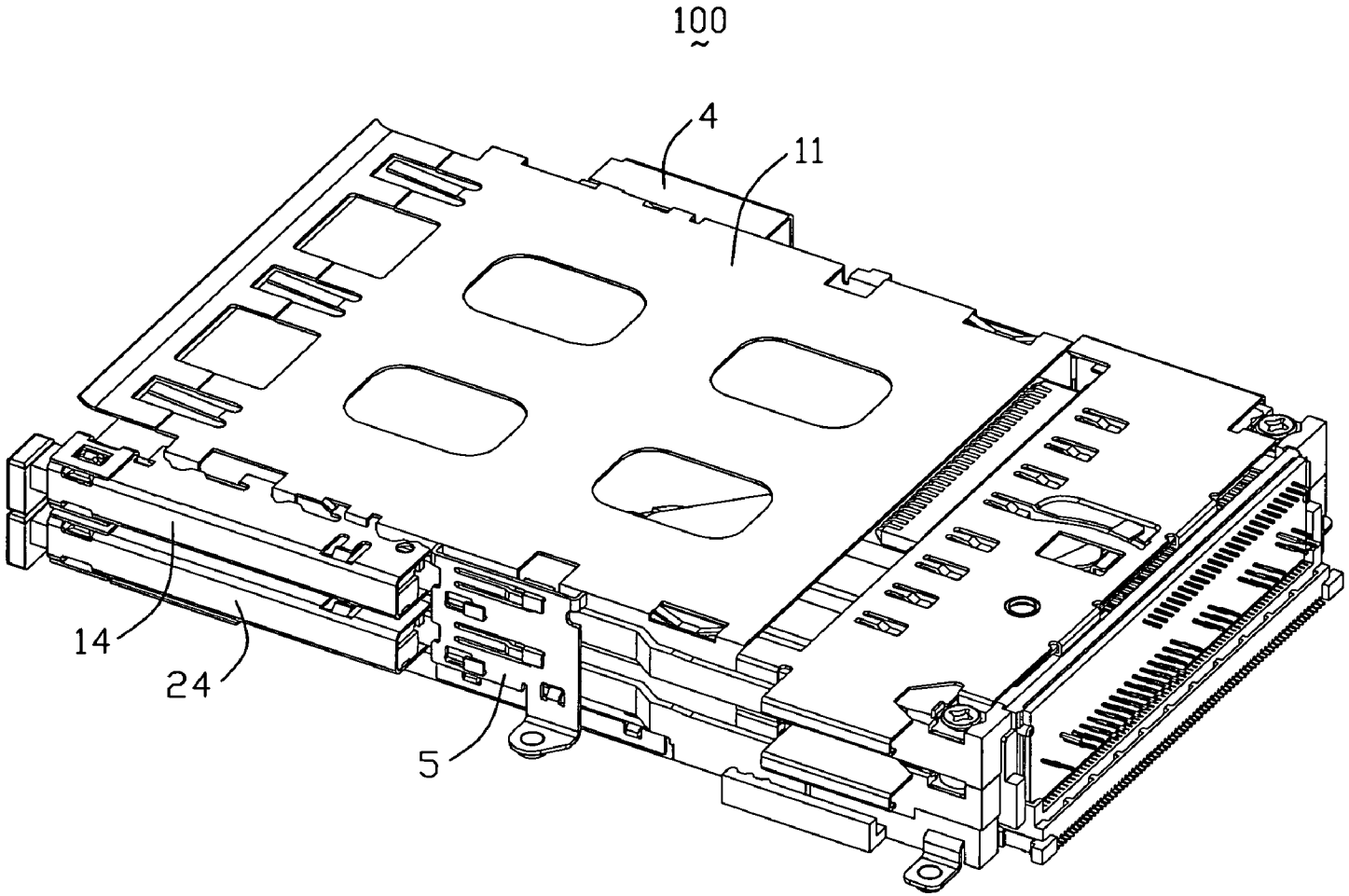
FIG. 8 is a perspective view of the electrical card connector similar to FIG. 1, but taken from a different aspect.
Figure 9:
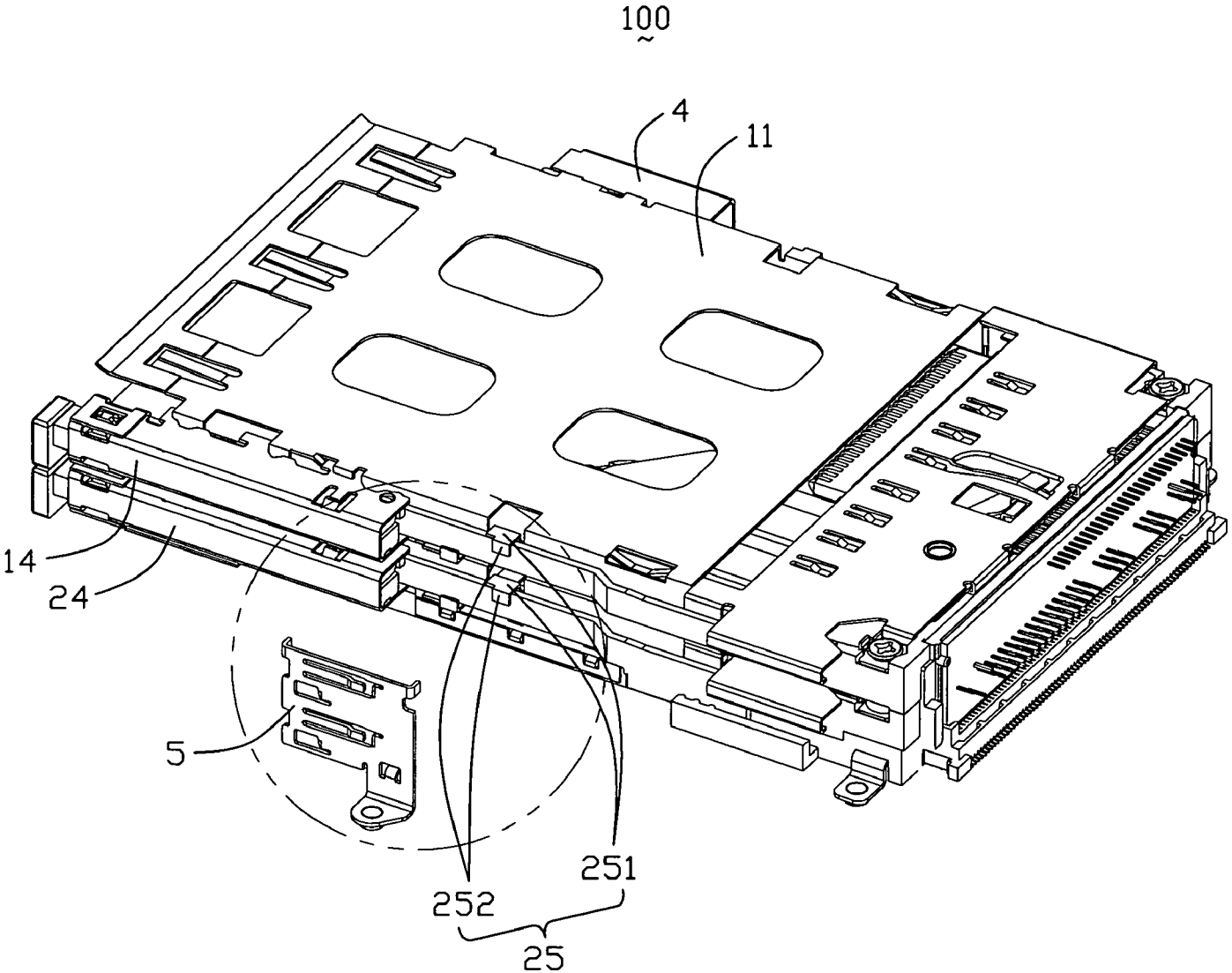
FIG. 9 is a perspective view of the electrical card connector and a supporting plate in accordance with the present invention.
Figure 10:
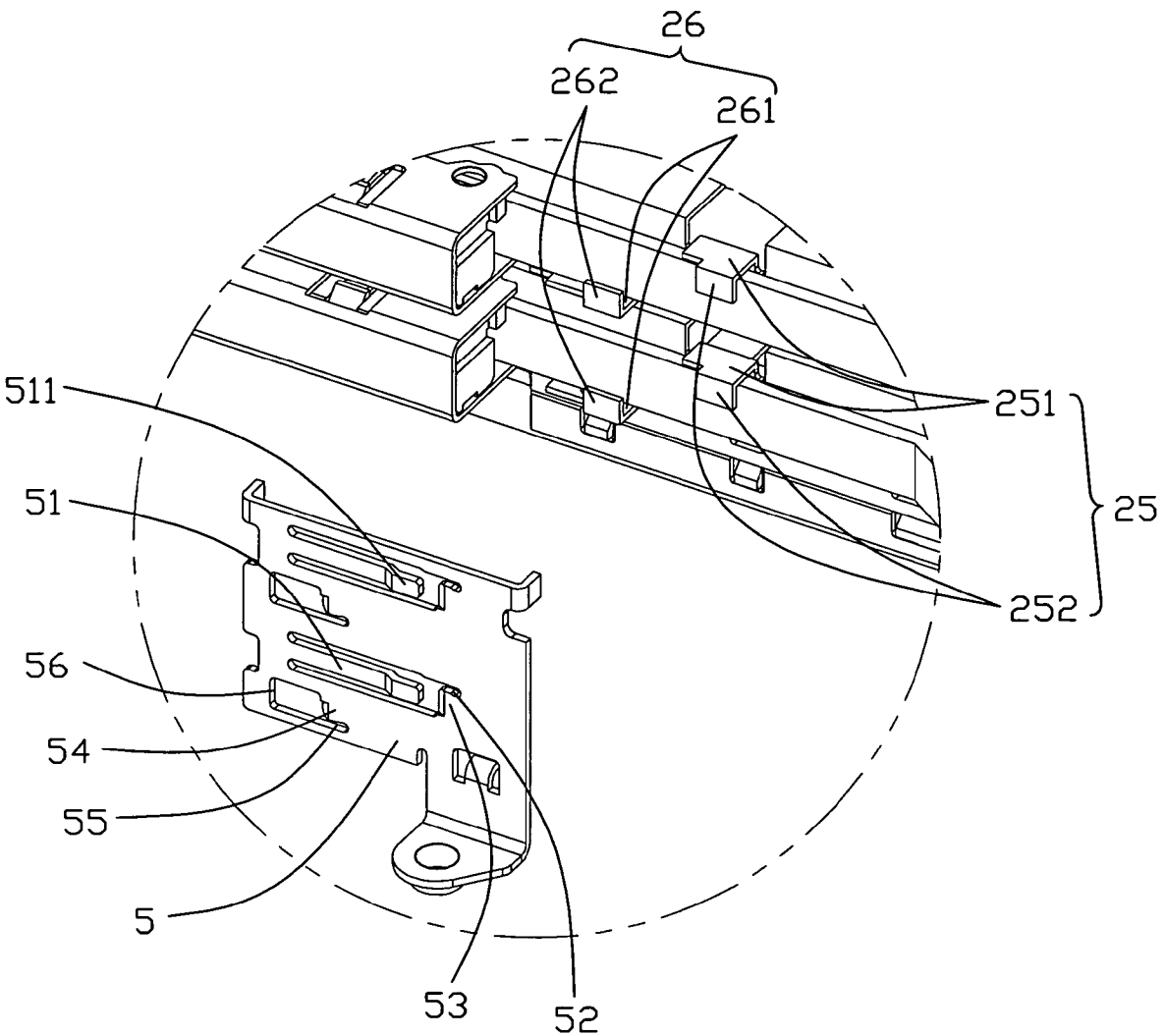
FIG. 10 is an enlarged view of the circled section shown in FIG. 9.

Referring to FIG. 6 and FIG. 7, a third connector 3 is shown. The third connector 3 mounted under the second connector 2 (shown in FIG. 4) has a third shield 32, a bottom plate 34 mating with the third shield 32 by a number of mounting portion 321, and a terminal module 36 retaining a number of third terminals 33 exposed in the third receiving room 30 for electrically connecting with the third card. With the third shield 32 mounted on the bottom plate 34, the third receiving room 30 (shown in FIG. 1) is defined. Corresponding to the screw holes of the second connector 2, a pair of screw holes (not labeled) are located on the end of the bottom plate 34.

As shown in FIG. 1 to FIG. 10, the first connector 1 and the second connector 2 are retained to each other by the supporting sections 5 and 4. Additionally, there are a pair of screws (not labeled) in turn go through the screw holes of the first connector 1, the second connector 2 and the third connector 3, thereby forming the electrical card connector 100 of the present invention.

There are a pair of first locking tabs 25, and a pair of second locking tabs 26 formed by the first shield 11 and the second shield 21, respectively, for retaining the supporting portion 5 on one lateral side of the electrical card connector 100. The supporting portion 4 is retained on the other lateral side of the electrical card connector 100 by a plurality of stabs (not labeled) of the supporting portion 4 locking with corresponding holes (not labeled) of the first shield 11 and the second shield 21. The first locking tabs 25 extend downwardly from the first shield 11 and the second shield 21, respectively. On the contrary, the second locking tabs 26 extend upwardly from the first shield 11 and the second shield 21, respectively. Each first locking tab 25 has a first horizontal portion 251 and a first vertical portion 252. Similarly, each second locking tab 26 has a second level portion 261 and a second vertical portion 262.

In accordance with the first locking tabs 25 and the second locking tabs 26, the supporting plate 5 forms a pair of spring branches 51 perpendicular to each other, and a pair of passing holes 56 located under the corresponding spring branches 51. In front of each spring branch 51, there is a narrow gap 52 defined by a first engaging plate 53. Each spring branch 51 has a protruding piece 511 protruding outwardly, so a space (not labeled) is formed between the protruding piece 511 and the narrow gap 52. Both of the passing holes 56 are defined with a second narrow gap 55 due to a second engaging plate 54 protruding into the passing holes 56, respectively.

When the supporting plate 5 is to be locked with the locking tabs 25 and 26, firstly, the second locking tabs 26 go through the corresponding passing holes 56 and, at the same time, the outer surfaces of the first vertical portions 252 confront with the inner surfaces of the protruding pieces 511, respectively, pressing the supporting plate 5 and making the protruding pieces 511 deflect outwardly. Thereafter, moving the supporting plate 5 backwardly makes the supporting plate 5, the locking bars 25 and 26 matched in such way that the first horizontal portions 251 are situated in the corresponding first narrow gaps 52, with the inner surfaces of the first vertical sections 252 engaging with the corresponding outer surfaces of the first blocks 53, lateral surfaces of the first vertical sections 252 engaging with the head surfaces of the protruding pieces 511, respectively. Then the outer surfaces of the first vertical sections 252 are in the same plane or level with the outer surfaces of the protruding pieces 511. This leveling arrangement prevents the supporting plate 5 from moving forwardly or backwardly. Regarding the second locking tabs 26, each second level section 261 is retained in corresponding second narrow gap 55, with the inner surfaces of the second perpendicular sections 262 confronting with the outer surfaces of the second blocks 54, preventing the supporting plate 5 from moving upwardly or downwardly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical card connector comprising:

a first connector including a first insulating housing, a first shield mounted on the first insulating housing to define a first receiving room, and a plurality of first terminals retained in the first insulating housing;

a second connector mounted under the first connector, the second connector including a second insulating housing and defining a second receiving room, and a plurality of second terminals retained in the second insulating housing;

wherein the first insulating housing comprises an embossment protruding into the second receiving room.

2. The electrical card connector as claimed in claim 1, wherein the second connector includes a grounding plate mounted between the first insulating housing and the second insulating housing.

3. The electrical card connector as claimed in claim 2, wherein the grounding plate has a setting portion engaged with the embossment.

4. The electrical card connector as claimed in claim 3, further comprising a third connector located under the second connector.

5. The electrical card connector as claimed in claim 1, wherein the second connector has a second shield located between the first connector and the second connector.

6. The electrical card connector as claimed in claim 5, further comprising a supporting section mounted on one lateral side thereof.

7. The electrical card connector as claimed in claim 6, wherein the supporting section has a pair of spring branches and a pair of passing holes under corresponding branches.

8. The electrical card connector as claimed in claim 7, wherein the first shield and the second shield form a pair of first tabs locking with corresponding spring branches.

9. The electrical card connector as claimed in claim 8, wherein the first shield and the second shield form a pair of second tabs locking with corresponding passing holes.

10. The electrical card connector as claimed in claim 9, wherein the first tabs tend downwardly from the first and the second shields, and the second tabs extend upwardly from the first and the second shields, respectively.

11. The electrical card connector as claimed in claim 10, wherein near each front end of the spring braches, the supporting section comprises a first narrow gap and a first engaging plate.

12. The electrical card connector as claimed in claim 11, wherein with the supporting section comprises a second narrow gap and a second engaging plate protruding into the passing hole.

13. The electrical card connector as claimed in claim 12, wherein each of the first tabs and the second tabs includes a horizontal section and a vertical section, the horizontal sections are retained in corresponding first narrow gaps and second narrow gaps, and the vertical sections engages with corresponding first engaging plate and second engaging plates.

14. The electrical card connector as claimed in claim 13, wherein the spring branches has a protruding plate, and an end portion of the vertical section of the first tab collides with a head portion of the protruding plate, respectively.

15. The electrical card connector as claimed in claim 5, wherein the first insulating housing of the first connector has a base section and a guiding plate extending backwardly from the base section and having a pair of locking holes, and the second shield of the second connector has a pair of locking pieces engaged with the locking holes.

16. An electrical connector assembly comprising:

a first connector unit having a first insulative housing and an upper shell on a top face thereof;

a plurality of first contacts disposed in the first housing and extending into a first card receiving space defined in the first connector unit;

a second connector unit having a second insulative housing located under the first connector with a middle shell sandwiched therebetween;

a plurality of second contacts disposed in the second housing and extending into a second card receiving space defined in the second connector unit;

a third connector unit having a third insulative housing located under the second connector with a lower shell sandwiched therebetween; and a plurality of third contacts disposed in the third housing and extending into a third card receiving space defined in the third connector; wherein a common post extends through all the first, the second and the third connectors for aligning all the first, the second and third connectors together, while the first and the second connector further includes a fastening device for commonly positioning the first, the second connector upon a printed circuit board on which the third connector is directly seated.

17. The electrical connector assembly as claimed in claim 16, wherein said third connector has another fastening device for fixing to the printed circuit board.

18. The electrical connector assembly as claimed in claim 16, wherein all the first, the second and third contacts are fastened to a vertical printed circuit board located on a rear portion of the connector assembly.

* * * * *